US005727411A

United States Patent [19]

Sakakibara et al.

[11] Patent Number: 5,727,411

[45] Date of Patent: Mar. 17, 1998

[54] METHOD OF FORMING GROOVES ON METAL PIPE AND GROOVE-FORMING APPARATUS

[75] Inventors: Tetsuya Sakakibara, Toyohashi; Yoshitaka Kuroda, Anjo, both of Japan

[73] Assignee: Denso Corporation, Kariya, Japan

[21] Appl. No.: 772,153

[22] Filed: Dec. 20, 1996

[30] Foreign Application Priority Data

Dec. 26, 1995 [JP] Japan ..... 7-339539

[51] Int. Cl.[6] ..... B21D 15/06

[52] U.S. Cl. ..... 72/110; 72/118; 72/121

[58] Field of Search ..... 72/106, 107, 110, 72/118, 121

[56] References Cited

FOREIGN PATENT DOCUMENTS

A-6-39468 2/1994 Japan .
1429554 3/1976 United Kingdom .

*Primary Examiner*—Lowell A. Larson
*Attorney, Agent, or Firm*—Harness, Dickey & Pierce

[57] ABSTRACT

Each of specific rollers which corresponds to one of the grooves is disposed in a circumference of the metal pipe at equal intervals and is pressed against the periphery of the metal pipe 10, thereby forming a plurality of the grooves at the same time. Because each of the grooves is formed by a specific forming roller, a plurality of the grooves can be formed separately, and the material of the wall between the grooves is prevented from being drawn. Thus, the grooves can be formed into a desired shape.

7 Claims, 5 Drawing Sheets

METHOD OF FORMING GROOVES ON METAL PIPE AND GROOVE-FORMING APPARATUS

BACKGROUND OF THE INVENTION

1. Field of the Invention

The present invention relates to a method of forming a plurality of grooves on a metal pipe and a groove-forming apparatus for forming a plurality of grooves on a pipe.

2. Description of the Related Art

A coolant-pipe-joint of an air conditioner for an automobile is, as shown in FIGS. 6 and 7, composed of a male pipe 10 having a pair of adjacent grooves 11 and 12 which receive O-rings 13 and 14, a female pipe 15 which receives the male pipe 10, and resinous joint members 16 and 17 which clamp both pipes 10 and 15 hermetically from the outside. The joint members 16 and 17 are hinged at one side and detachably fastened at the other side. The grooves 11 and 12 are formed by a plurality of forming rollers at the same time.

However, if each of the forming rollers has a pair of parallel annular flanges and if the grooves of the male metal pipe are formed by the rollers at the same time, material (such as aluminum alloy or the like) of a wall 18 formed between the grooves 11 and 12 shown in FIG. 8 is pulled in directions indicated by arrows F and G. As a result, it is difficult to form the grooves 11 and 12 and the wall 18 into suitable shapes.

SUMMARY OF THE INVENTION

The above problem can be solved if each of the grooves is formed one by one. However, the productivity of the groove-forming is low, resulting in a high production cost.

An object of the present invention is to form a plurality of annular grooves of a desired shape on a pipe with high productivity.

In order to attain the above object of the present invention, a plurality of specific forming rollers are provided to correspond to the number of the grooves. Each of the forming rollers is positioned at a different portion on a common circumference of the metal pipe so that the forming rollers are pressed against the outer periphery of the metal pipe at portions different from each other.

Thus, each of the annular grooves is formed separately at a different portion of a circumference. In other words, all the annular grooves are not formed jointly by a plurality of the forming rollers at the same time. Accordingly, material of the wall between the annular grooves is not pulled toward opposite sides, and, accordingly, a plurality of the annular grooves are formed into a desired shape at the same time and at a high productivity.

BRIEF DESCRIPTION OF THE DRAWINGS

Other objects, features and characteristics of the present invention as well as the functions of related parts of the present invention will become clear from a study of the following detailed description, the appended claims and the drawings. In the drawings:

FIGS. 5A, 5A1, 5A2, FIGS. 5B, 5B1, FIGS. 5C, 5C1, and FIGS. 5D, 5D1 are schematic diagrams showing respective steps of forming grooves according to the present invention;

DETAILED DESCRIPTION OF THE PREFERRED EMBODIMENTS

Figure 1:
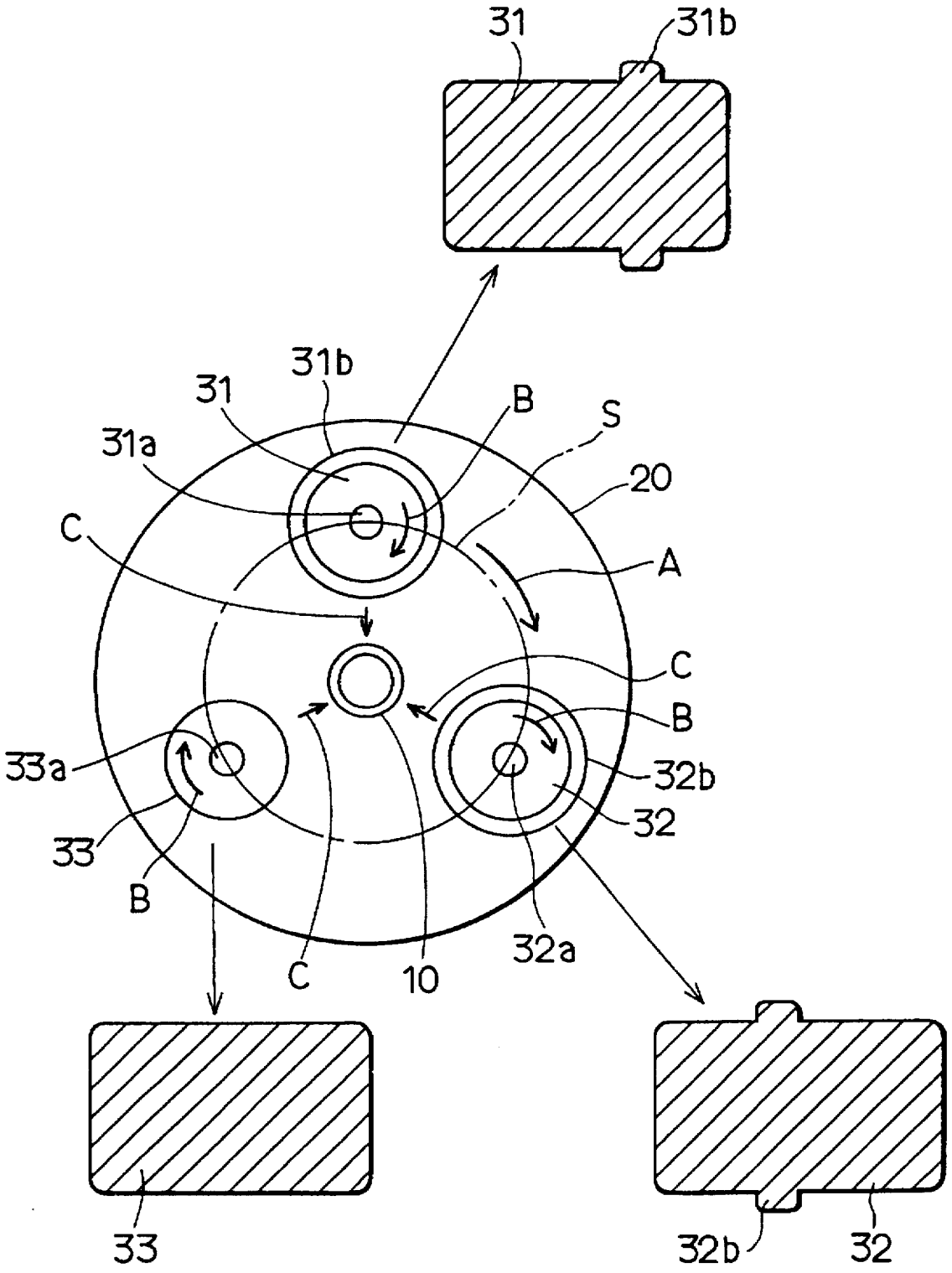
FIG. 1 is a schematic view illustrating forming rollers according to a first embodiment of the present invention.

A first embodiment is described with reference to FIGS. 1–5.

A turn table 20 has three rollers 31, 32 and 33 disposed at equal intervals on a circle S which is concentric to the rotating axis of the turn table 20. Each of central axes 31*a*, 32*a* and 33*a* of the rollers 31, 32 and 33 is rotatably supported by the turn table 20 via a bearing (not shown).

Each of the rollers 31, 32 and 33 rotates together with the turn table in a direction shown by an arrow A in an orbit. When each of the rollers 31, 32 and 33 comes in contact with an outer periphery of a work piece (that is, a metal pipe) 10 which is fixed at the center of rotation of the turn table 20, each of the rollers 31, 32 and 33 is rotated on its axis (autorotation) by a frictional force generated between the work piece 10 and each of the rollers 31, 32 and 33.

The turn table 20 has a chuck, which is well-known as a part of a lathe, and the each of the rollers 31, 32 and 33 is sent to the work piece 10 by the chuck in the directions indicated by arrows C.

Each of the forming rollers 31 and 32 has an annular flange 31*b* and 32*b*, respectively formed integrally at a longitudinal position on the outer periphery thereof corresponding to one of the grooves 11 and 12. The forming roller 31 forms the groove 11 and the forming roller 32 forms the groove 12. In other words, the annular flanges 31*b* and 32*b* are located at portions different from each other to correspond to each of the grooves 11 and 12.

The roller 33 has a cylindrical shape with no flange for forming such a groove 11 or 12 and supports the work piece 10 against the forming rollers 31 and 32.

The work piece 10 is a metal pipe made of aluminum or the like to be used for a coolant-pipe-joint of a car-air-conditioner.

Figure 3:
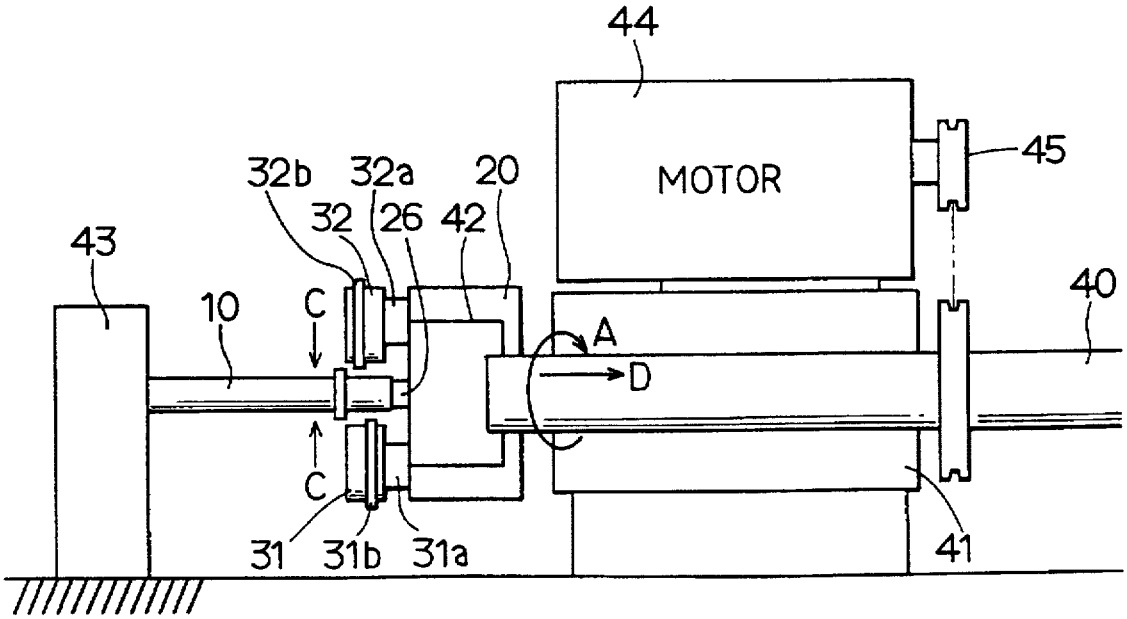
FIG. 3 is a schematic view illustrating a groove-forming apparatus according to the first embodiment of the present invention.
Figure 4:
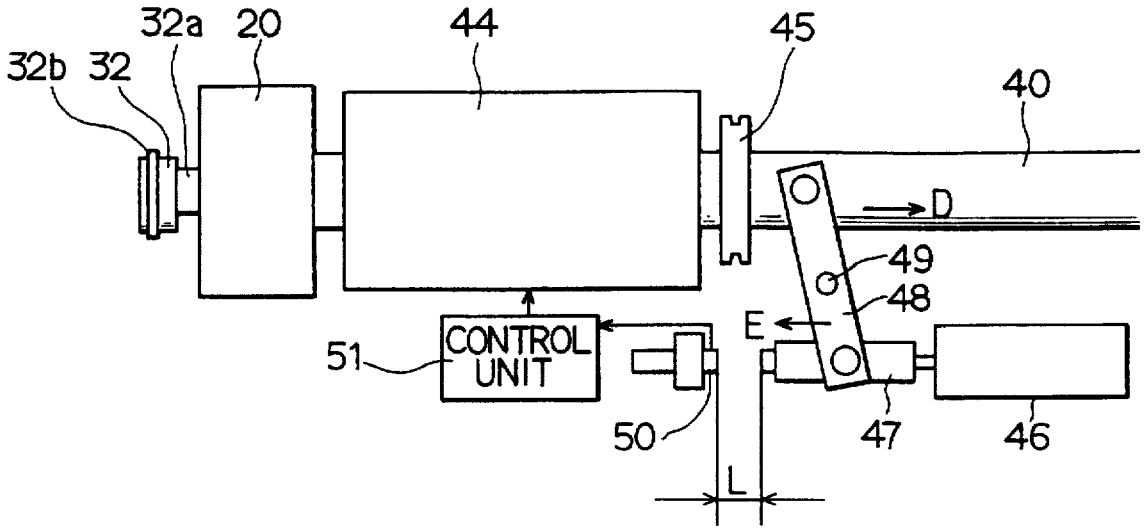
FIG. 4 is a schematic view illustrating a main portion of the groove-forming apparatus shown in FIG. 3.
Figure 6:
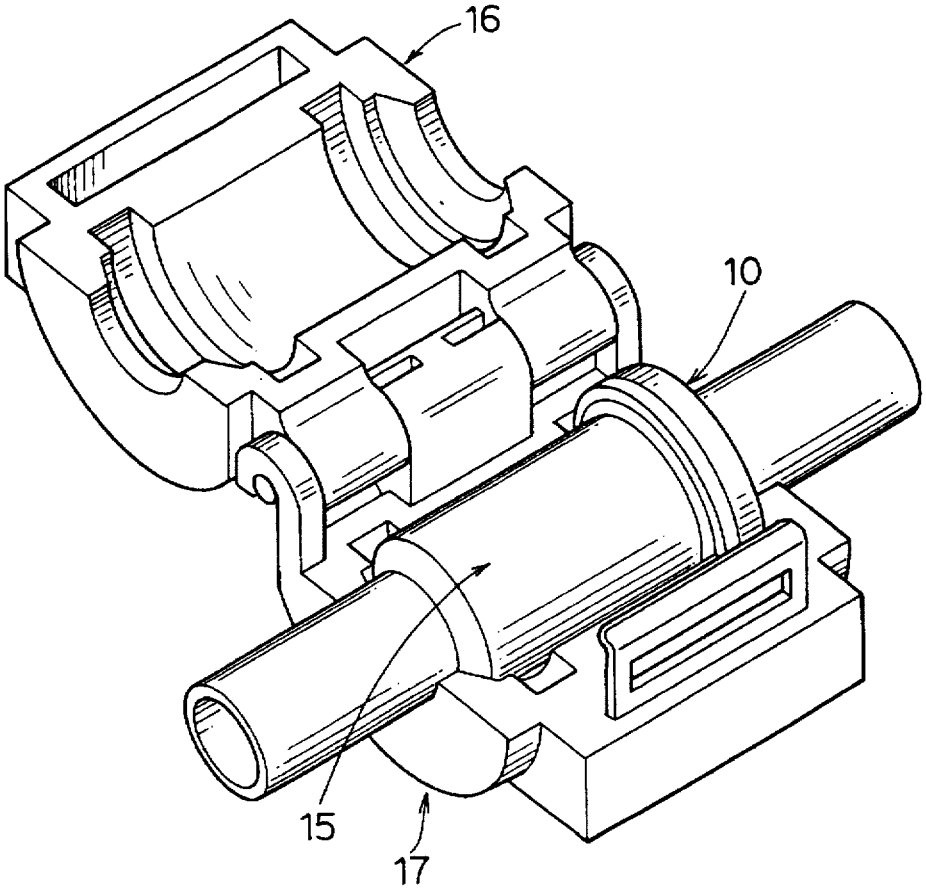
FIG. 6 is a perspective view illustrating a pipe-joint composed of a metal pipe having grooves.

As shown in FIGS. 3 and 4, the turn table 20 is connected to an end of a driving shaft 40 to be rotated thereby in a direction indicated by an arrow A. The driving shaft 40 is rotatably supported by a bearing box 41 so as to reciprocate longitudinally as indicated by an arrow D in FIG. 3. The chuck is disposed in a space defined by one end of the driving shaft 40 and the axes of the three rollers 31, 32 and 33. When the driving shaft 40 moves in a direction indicated by the arrow D, the chuck 42 moves each of the rollers 31, 32 and 33 in directions indicated by arrows C toward the work piece 10.

The work piece 10 is supported by a positioning device 43 to be positioned at the center of rotation of the turn table 20 with one end thereof being supported by a supporting shaft 26 which extends from the turn table 20. An AC motor 44 is disposed above the bearing box 41 to drive the driving shaft 40 via a pulley-and-belt mechanism 45. The motor 44 is controlled by a well-known inverter control circuit.

In FIG. 4, a feed cylinder 46 reciprocates a rod 47 right and left in FIG. 4. The reciprocating speed of the rod 47 is controlled by fluid (oil or the like) pressure supplied into the feed cylinder 46. The rod 47 is connected to the driving shaft 40 through a link lever 48. When the rod 47 is moved in a direction indicated by an arrow E, the link lever 48 turns about a fulcrum 49 to move the driving shaft 40 in a direction indicated by an arrow D.

A limit switch 50 is disposed near the rod 47. The limit switch 50 detects a prescribed distance L of the feed stroke of the rod 47 and sends an output signal thereof to a control circuit 51, which controls the motor 44 and a control valve (not shown) disposed in a fluid passage of the feed cylinder 46.

A method of forming the grooves according to the present invention is described next.

The work 10 is supported by the positioning device 43 and positioned at the rotating center of the turn table 20. When the motor 44 rotates the driving shaft 40, the turn table 20 and the rollers 31, 32 and 33 are rotated in the direction as indicated by the arrow A.

On the other hand, the feed cylinder 46 moves the rod 47 in the direction indicated by the arrow E so that the lever 48 moves the driving shaft 40 in the direction indicated by the arrow D. Consequently, the chuck 42 sends the rollers 31, 32 and 33 in the direction indicated by the arrows C and presses them against the outer periphery of the work piece 10. When the rollers 31, 32 and 33 come in contact with the outer periphery of the work piece 10, the rollers 31, 32 and 33 are rotated by the frictional force generated between each of the rollers 31, 32 and 33 and the work piece 10 in the direction indicated by the arrow B (autorotation).

In this stage, the work piece 10 is supported stably by the rollers 31, 32 and 33 located at equal intervals on a circumference of the work piece, and annular grooves 11 and 12 are being formed by the annular flanges **31*b* and 32*b* of the forming rollers 31 and 32**.

The process of forming the grooves 11 and 12 for O-rings 13 and 14 by the annular flanges **31*b* and 32*b* is described with reference to FIGS. 5A–5D, in which the supporting roller 33 is omitted because it does not participate with the groove-forming, and the forming rollers 31 and 32** are illustrated to be located at opposite (180° in angle) positions for convenience. The sectional views of portions in circles indicated by X and Y are shown in FIGS. 5A1 and 5A2 and FIGS. 5B1–5D1.

Figure 2:
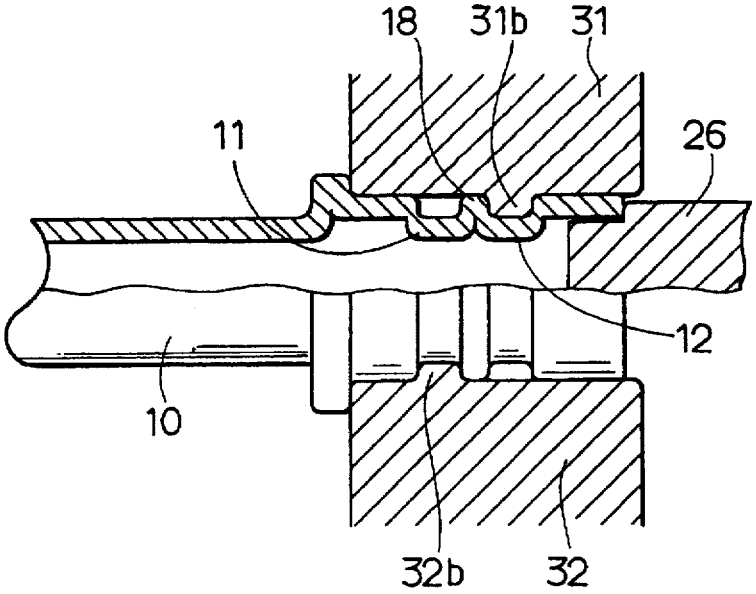
FIG. 2 is a cross-sectional view illustrating a forming roller in the groove-forming.
Figure 5A:
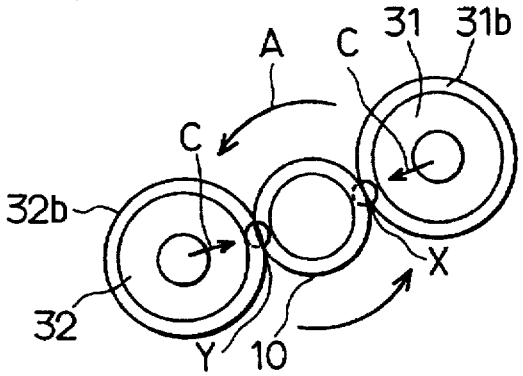
Figure 5A:
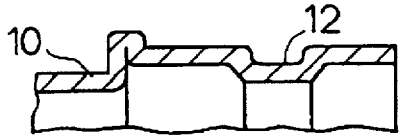
Figure 5A:
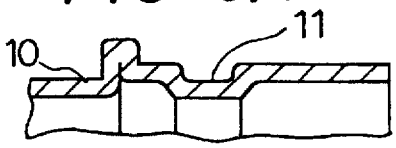

FIG. 5A illustrates the work piece 10 being pressed by the annular flanges **31*b* and 32*b* when the groove-forming is started. The forming rollers 31 and 32 are located at different positions in a circumference of the work piece, and each of the rollers 31 and 32 has a specific annular flange 31*b* or 32*b*, respectively. Therefore, each of the grooves 11 and 12 is formed at a different position (X or Y) on the common circumference. That is, the front groove 11 is formed at the position indicated by X and the rear groove 12** is formed at the position indicated by Y as illustrated in FIGS. 5A1 and 5A2.

Figure 5B:
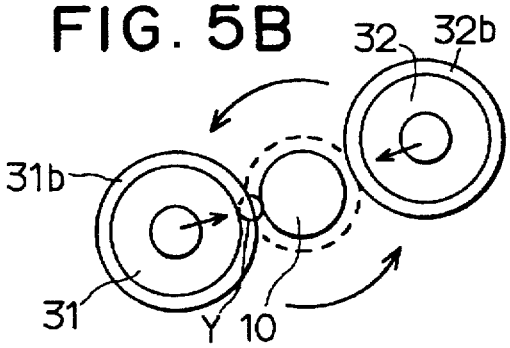
Figure 5B:
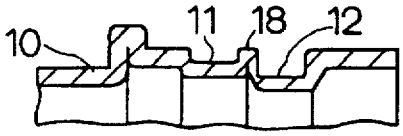

FIG. 5B illustrates the rollers 31 and 32 making a half turn (by an angle 180°) in an orbit to form the grooves 11 and 12. The rollers 31 and 32 are moved radially inside as indicated by the arrow C while they are turning. Accordingly, the rollers 31 and 32 continue to form the groove 11 separately from the groove 12 as shown in FIG. 5B1.

Figure 5C:
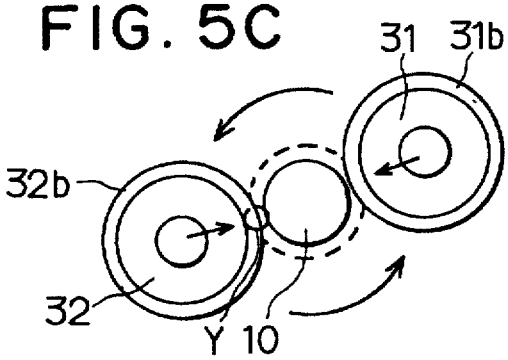
Figure 5C:
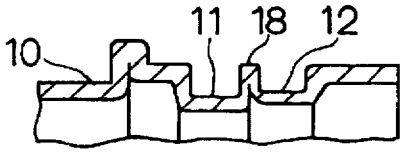

FIG. 5C illustrates the rollers 31 and 32 making another 180° turn so that the groove 12 is formed by the roller 32 at the portion Y as shown in FIG. 5(*c*). The rollers 31 and 32 are moved further in the direction indicated by the arrow C while turning thereafter to form the grooves 11 and 12.

Figure 5D:
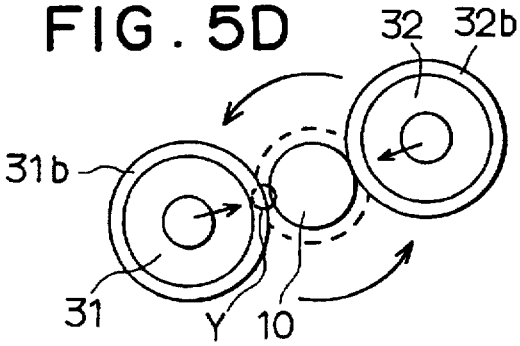
Figure 5D:
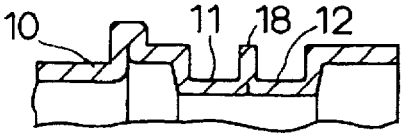
Figure 7:
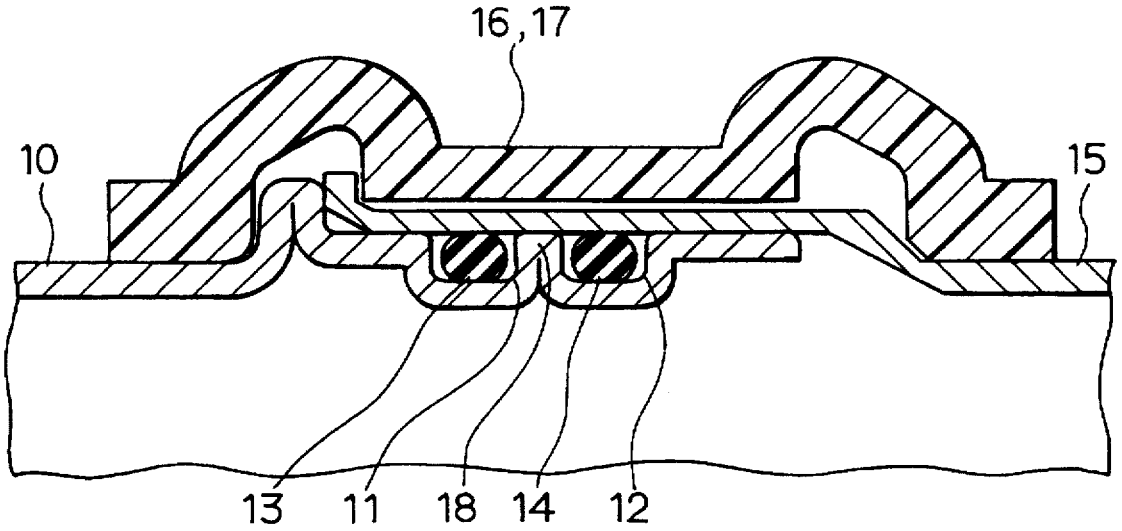
FIG. 7 is a cross-sectional view of a main portion of the pipe-joint shown in FIG. 6.
Figure 8:
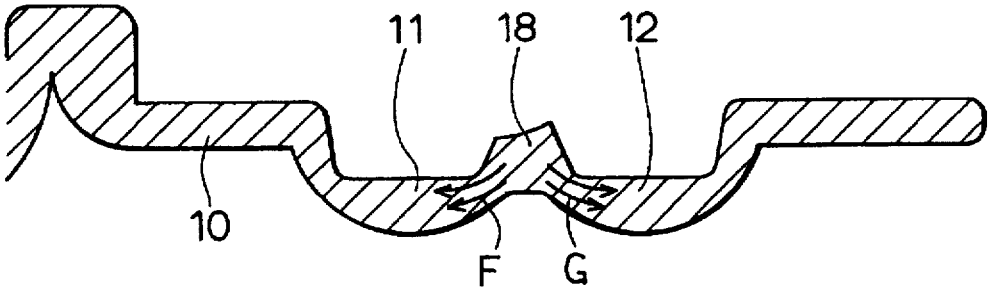
FIG. 8 is an enlarged cross-sectional view illustrating a portion of a metal pipe having annular grooves and a wall therebetween.

FIG. 5D illustrates the final stage of the groove forming, where the feed stroke of the rod 47 becomes the prescribed amount L shown in FIG. 4. Consequently, the limit switch 50 detects the amount L and sends the output thereof to the control circuit 51 shown in FIG. 4, which drives the control valve of the fluid passage of the feed cylinder 46 according to the signal to stop the motion of the rod 47.

Thus, the motion of the rollers 31 and 32 in the directions indicated by C is stopped, while each of the rollers 31 and 32 rotates on its own axis and rotates in the same orbit to form the groove into a desired shape (or size). The orbital rotation is continued for a period decided by a timer circuit of the control circuit 51 after the limit switch 50 sends the output signal. Thereafter, the motor 44 stops automatically and the orbital rotations of the rollers 31 and 32 stop, thus all the steps are completed.

In the method according to the present invention, each of the grooves 11 and 12 is formed at a position different from each other (X or Y) on a circumference of the work piece 10, that is, each of the grooves 11 and 12 is not formed at the same position. Therefore, the material of the wall 18 between the grooves 11 and 12 is not pulled (or deformed) toward the grooves 11 and 12 located in the opposite directions.

Thus, a pair of the grooves 11 and 12 are formed into a desired shape at the same time.

Second Embodiment

Instead of rotating the forming rollers 31 and 32 around the work piece 10 which is positioned at the rotating center of the turn table 20, the work piece 10 can be rotated by a motor after fixing the work piece 10 to the rotating center of the turn table 20. In this case, the rollers 31 and 32 are not rotated around the work piece 10 but moved only in the direction indicated by the arrow C to press them against the outer periphery of the work piece 10 while allowing them to rotate on their own axes. Thus, each of the grooves 11 and 12 is formed at a position different from another (indicated by X or Y) on a circumference of the work piece.

In the second embodiment, a pair of the grooves is formed to receive O-rings on the metal pipe 10 for a coolant-pipe-joint of a car air-conditioner. However, more grooves can be formed by the same method according to the present invention. The grooves other than the grooves 11 and 12 for O-rings 13 and 14 can be formed on a metal pipe.

In the above described embodiment, the supporting roller 33 is not always necessary. If the work piece 10 is fixed stably during the groove-forming by the rollers 31 and 32, the supporting roller 33 can be omitted.

Instead of the supporting roller 33, a finishing roller having a pair of annular flanges can be used to finish the grooves 11 and 12.

The method of forming the grooves 11 and 12 according to the present invention can be applied to a pipe made of a metal other than aluminum alloy such as copper alloy, iron alloy or the like.

In the foregoing description of the present invention, the invention has been disclosed with reference to specific embodiments thereof. It will, however, be evident that various modifications and changes may be made to the specific embodiments of the present invention without departing from the broader spirit and scope of the invention as set forth in the appended claims. Accordingly, the description of the present invention in this document is to be regarded in an illustrative, rather than restrictive, sense.

What is claimed is:

1. A method of forming a plurality of annular grooves on a metal pipe comprising steps of:

providing a plurality of forming rollers each of which has an annular flange for forming a specific one of said grooves;

positioning each of said rollers at a portion different from each other on a circumference of said metal pipe; and pressing each of said flanges against an outer periphery of said metal pipe at the same time to form said grooves at separate portions thereof.

2. A method of forming a plurality of annular grooves on a metal pipe as claimed in claim 1, wherein said pressing step comprises:

fixing said metal pipe, moving said rollers radially inside from outside to said outer periphery of said metal pipe, rotating said rollers around said metal pipe, and pressing said rollers against said outer periphery of said metal pipe.

3. A method of forming a plurality of annular grooves on a metal pipe as claimed in claim 1, wherein said pressing step comprises:

rotating said metal pipe, moving said rollers from outside toward said metal pipe, and pressing said rollers against said outer periphery of said metal pipe.

4. A method of forming a plurality of annular grooves on a metal pipe as claimed in claim 1 further comprising steps of:

providing a supporting roller, and positioning said supporting roller at a portion around said metal pipe different from positions of said forming rollers.

5. An apparatus of forming a plurality of annular grooves on a metal pipe comprising:

a number of forming rollers each of which has a specific flange disposed to correspond to one of said grooves, each of said rollers being positioned at a different portion of a common circumference of said metal pipe; and a roller-feed unit for moving said roller radially inside to press each of said flanges against said metal pipe, thereby forming said annular grooves at the same time.

6. An apparatus for forming a plurality of annular grooves on a metal pipe as claimed in claim 5 further comprising:

means for fixing and supporting said metal pipe, and a roller rotating means for rotating said forming rollers so that an edge of said flange of each of said rollers rotates on a common circumference of said metal pipe.

7. An apparatus for forming a plurality of annular grooves on a metal pipe as claimed in claim 6, wherein said roller feed unit comprises means for reciprocating said roller rotating means to control motion of said flange.

* * * * *